US005704164A

United States Patent [19]

Huang

[11] Patent Number: 5,704,164

[45] Date of Patent: Jan. 6, 1998

[54] FOLDABLE FENCE

[76] Inventor: Li-chu Chen Huang, No. 9, Alley 2, Lane 606, Sec. 2, Po-ai Road, Chiayi City, Taiwan

[21] Appl. No.: 651,983

[22] Filed: May 21, 1996

Related U.S. Application Data

[63] Continuation-in-part of Ser. No. 574,762, Dec. 19, 1995, Pat. No. 5,575,113.

[51] Int. Cl.[6] ..... E06B 3/68

[52] U.S. Cl. ..... 49/55; 49/465; 160/372

[58] Field of Search ..... 49/55, 465, 463; 160/372, 376; 5/99.1; 403/92, 93, 94, 96; 16/334

[56] References Cited

U.S. PATENT DOCUMENTS

| | | | |
|---|---|---|---|
| 4,190,974 | 3/1980 | Siler | 160/377 |
| 4,294,560 | 10/1981 | Larkin | 403/104 |
| 4,465,262 | 8/1984 | Itri et al. | 160/374 |
| 4,583,715 | 4/1986 | Wright | 49/55 |
| 4,865,929 | 9/1989 | Smahlik et al. | 403/297 |
| 5,377,368 | 1/1995 | Cheng | 5/99.1 |
| 5,404,674 | 4/1995 | Gethers, Jr. | 49/56 |
| 5,454,124 | 10/1995 | Huang | 5/99.1 |
| 5,457,828 | 10/1995 | Huang | 5/99.1 |
| 5,504,951 | 4/1996 | Yeh | 5/99.1 |
| 5,513,399 | 5/1996 | Weng | 5/99.1 |
| 5,530,977 | 7/1996 | Wang | 5/99.1 |

*Primary Examiner*—Kenneth J. Dorner
*Assistant Examiner*—Curtis Cohen
*Attorney, Agent, or Firm*—Thomas, Kayden, Horstemeyer & Risley

[57] ABSTRACT

A foldable fence for confining babies includes a plurality of first supporting means, second supporting means, folding means, multiple tubes and supporting rods. The tubes each further have a mid-section with an eccentric member enclosed therein, so that when using the mid-section to extend the length of the tube is completed, turning the tube will make the eccentric member abut a peripheral side wall of the tube and therefore the length of the tube is fixed. The second supporting means provides a clearance for a rivet to move back and forth, so that when the second means abuts against a surface, such as a wall, a resilient member will provide a resilient force to further stabilize the abutting to the wall. The folding means connected between two supporting rods provides a folding mechanism to the foldable fence constructed in accordance with the present invention, such that the foldable fence is folded together to minimize the size when the use of the fence is finished.

8 Claims, 10 Drawing Sheets

FOLDABLE FENCE

REFERENCE TO RELATED APPLICATION

The present application is a continuation-in-part (CIP) application of application Ser. No. 08/574,762 now U.S. Pat. No. 5,575,113; entitled: "DOOR GUARD RAIL STRUCTURE" that was filed in the U.S. Patent and Trademark Office on Dec. 19, 1995.

FIELD OF THE INVENTION

The invention generally relates to a fence, and more particularly to a foldable fence able to confine babies within a certain region.

BACKGROUND OF THE INVENTION

This invention has a particular application to a fence which is useful for parents to confine babies from getting out of a particular place or region.

Referring to FIG. 1, a guard rail structure 1 comprises a first vertical tube 10 and a second vertical tube 12 arranged parallel with each other and each has two distal ends. Two first support members 20 are each fixedly mounted on one of the two distal ends of the first vertical tube 10 and two second support members 30 are each fixedly mounted on one of the two distal ends of the second vertical tube 12.

Two first fastener members 40 are each horizontally mounted on a corresponding one of the two first support members 20 and two second fastener members 80 are each horizontally and rotatably mounted on a corresponding one of the two second support members 30.

Two first horizontal tubes 60 each have a first distal end mounted in a corresponding one of the two first fastener members 40. Two second horizontal tubes 68 each have a first end fixedly mounted in a corresponding one of the two second fastener members 80 to rotate therewith, and a second distal end slidably received in a corresponding one of the two first horizontal tubes 60.

Two eccentric members 70 each include a plug 72 securely mounted in the second distal end of a corresponding one of the two second horizontal tubes 68 to move therewith and each include an eccentric shaft 74 extending from the plug 72 thereof. Two annular eccentric clamps 75 each include an inner wall (not shown) rotatably mounted on the eccentric shaft 74 of a corresponding one of the two eccentric members 70 and each include an outer wall 752 detachably rested against an inner wall (not numbered) of an associated first horizontal tube 60.

A structure as described above when in cooperation with walls surely has functions of guarding babies and confining them within a particular area. Nevertheless, it still suffers from several disadvantages.

A thus constructed structure is not convenient for a user to carry or transfer it from one place to another. When a user tries to carry the structure from one place to another, he/she might have to disassemble the whole structure into pieces, then he/she is able to carry all the pieces around, otherwise a user will need a large space for carrying or transferring the whole structure all at once.

A thus constructed structure is very hard for a user to put in storage and it takes too much time to disassemble and assemble the structure again and again. To store the whole structure, a user might need a large space or he/she will have to break down the structure then he/she can put the pieces aside, and to reassemble all the pieces together the next time the structure is needed. Such a procedure of assembling or disassembling for storage not only wastes time but also wastes man power.

Therefore, the present invention provides an improved foldable fence to mitigate and/or obviate the aforementioned problems.

SUMMARY OF THE INVENTION

In accordance with one aspect of the invention, the main objective of the invention is to provide a foldable fence which can be folded together without disassembling any part of the fence structure.

In accordance with another aspect of the present invention, another objective is to provide a compact and easily operated foldable fence, which is configured to have a push-in button actuable in securing or releasing the fence.

Still another objective of the invention is to provide a folding means which is easy to operate and inexpensive.

Other objects, advantages and novel features of the invention will become more apparent from the following detailed description when taken in conjunction with the accompanying drawings.

BRIEF DESCRIPTION OF THE DRAWINGS

The present invention will now be better understood with the reference of the accompanying drawings wherein.

DETAILED DESCRIPTION OF THE PREFERRED EMBODIMENT

Figure 1:
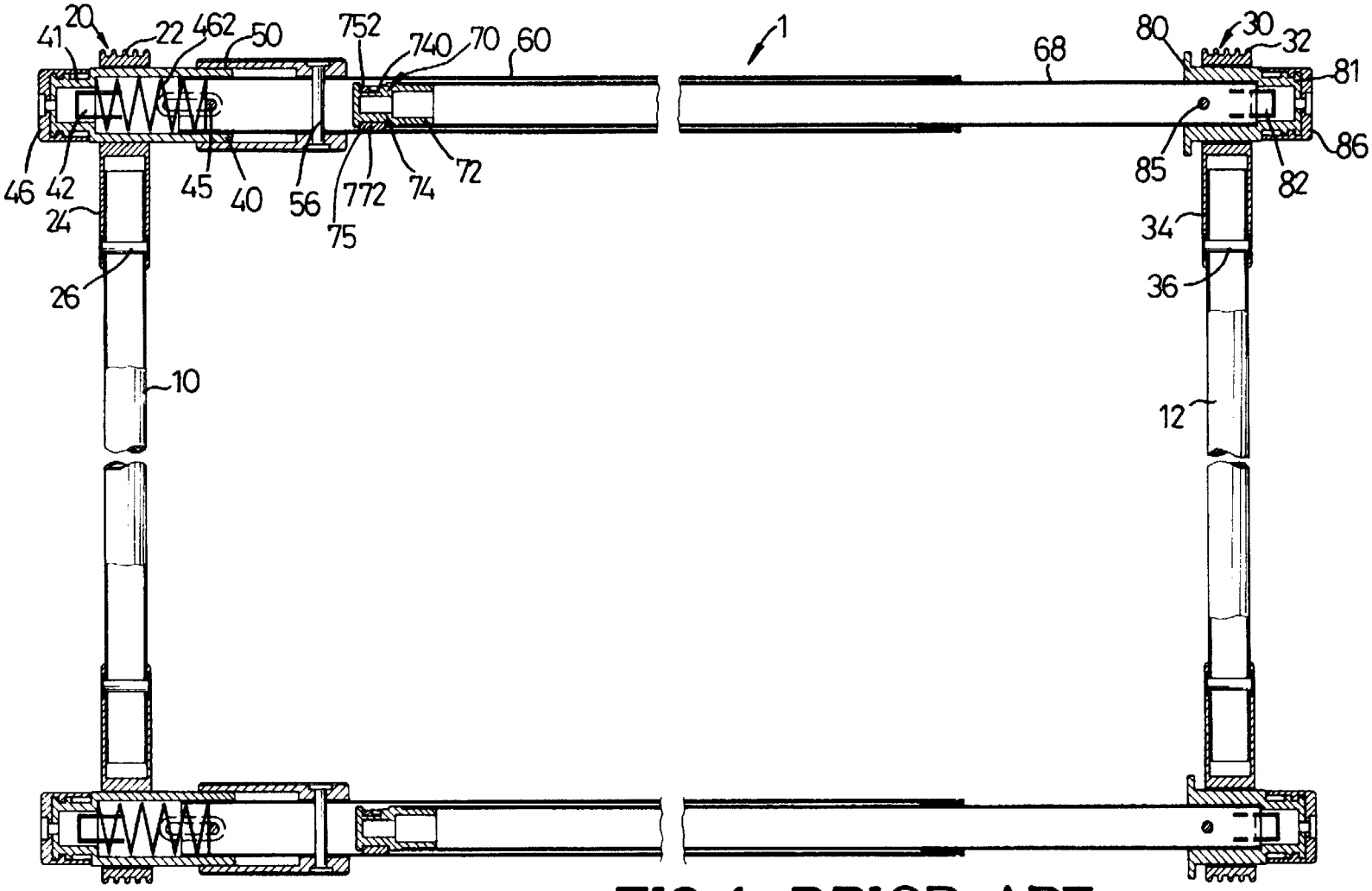
FIG. 1 PRIOR ART
FIG. 1 is a cross sectional view of a prior guard rail structure.
Figure 2:
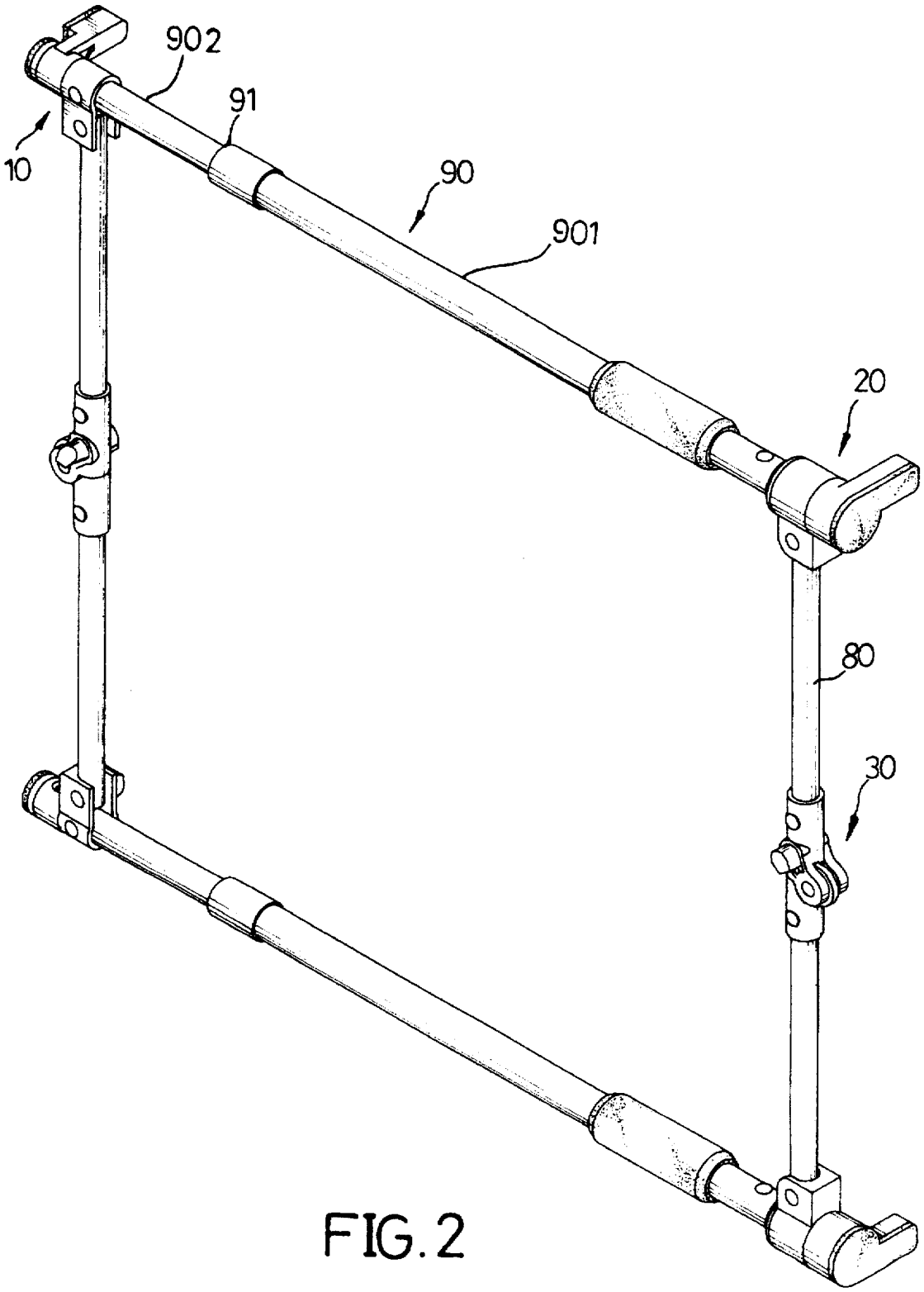
FIG. 2 is a perspective view of a foldable fence having a folding means mounted therebetween.

Referring to the drawings and particularly FIG. 2, a foldable fence constructed in accordance with the present invention is shown. The foldable fence includes a plurality of first supporting means 10, a plurality of second supporting means 20, a plurality of folding means 30, multiple telescopic tubes 90 connected between the first supporting means 10 and the second supporting means 20 and a plurality of supporting rods 80 having two distal ends each pivotally connected between two first supporting means 10 and two second supporting means 20. All the tubes 90 between the first supporting means 10 and the second supporting means 20 have two distal ends each of which is fixedly received within the first supporting means 10 and the second supporting means 20 and two mid-sections 901 and 902 one of which is rotatably received within the other. An eccentric member 91 is enclosed within one of the mid-section of the tube 90 and between the first supporting means 10 and the second supporting means 20, thus when turning one of the mid-sections, the eccentric member 91 will abut a peripheral side wall of the tube 90 and thereby fixing the tube 90 after the extension of the tube 90 is completed.

Figure 4:
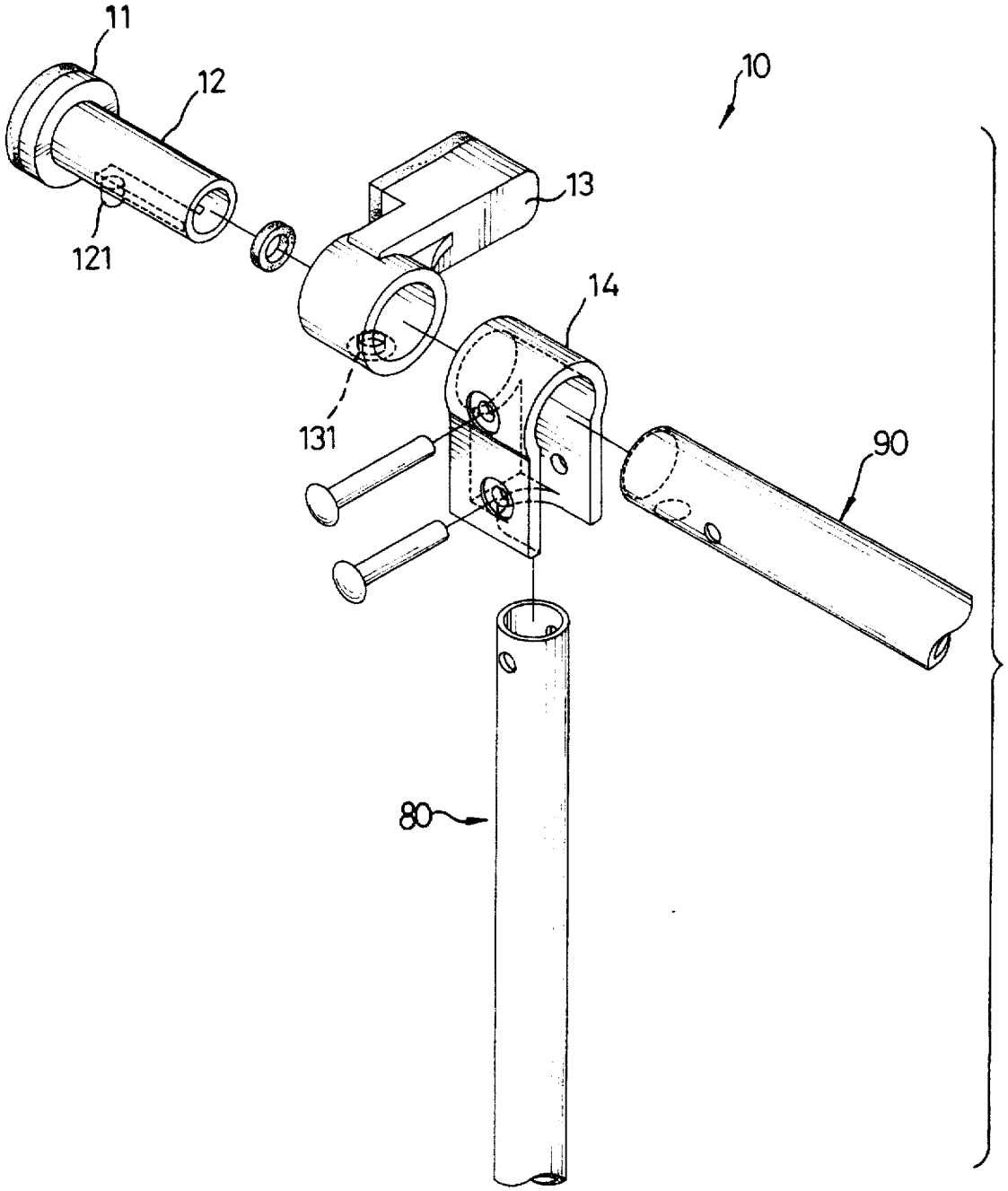
FIG. 4 is a partial exploded view of a first supporting means.
Figure 5:
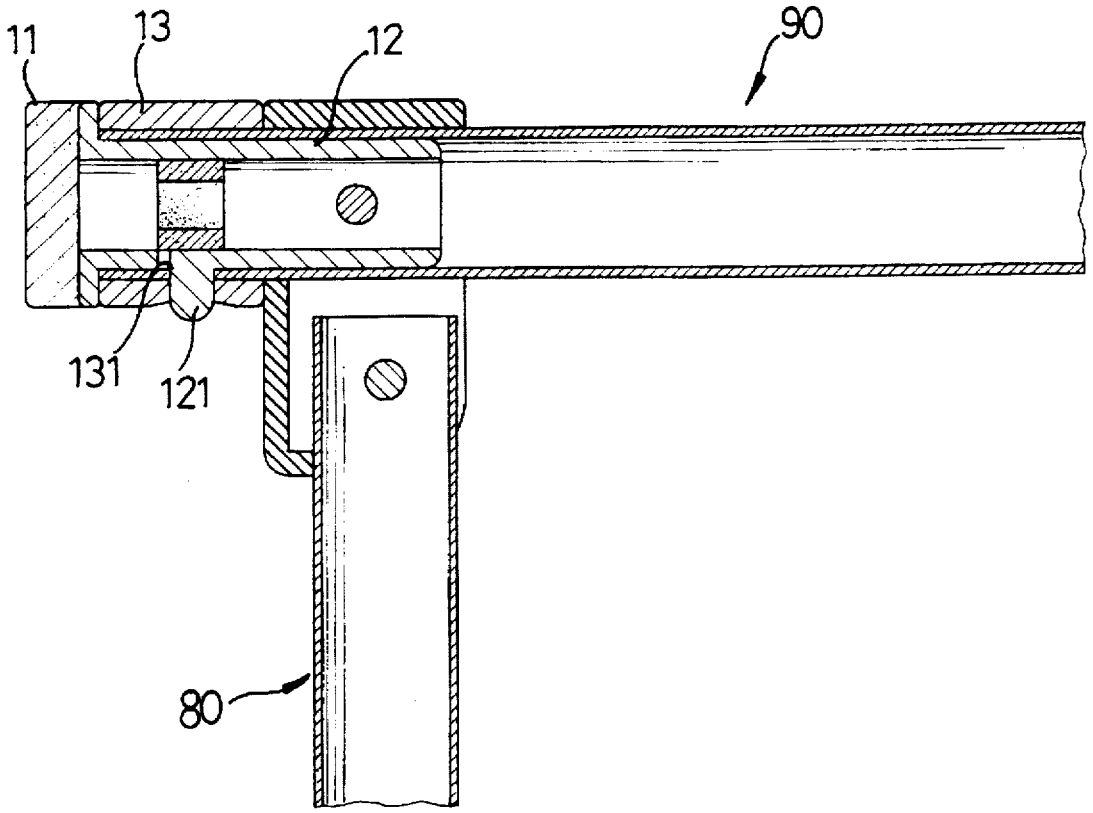
FIG. 5 is a schematic view showing the operation of FIG. 3.

An exploded view of the first supporting means 10 can be seen from FIG. 4. The first supporting means 10 comprises an end 11 having an annular projection 12 extended axially, a boss 121 integrally and perpendicularly formed on the projection 12, a driving plate 13 rotatably enclosing the annular projection 12 therein having a hole 131 for receiving the boss 121 of the annular projection 12, a coupler securely fixed on the annular projection 12 for fixedly connecting with one distal end of the tube 90 and pivotally connected with one distal end of the supporting rod 80. From FIG. 5, it is noted that the cross sectional view of the first supporting means 10 is shown. The driving plate 13 is able to freely rotate around the annular projection 12 if the boss 121 is extended into the hole 131 of the driving plate 13 for a better folding position of the driving plate 13.

Figure 3:
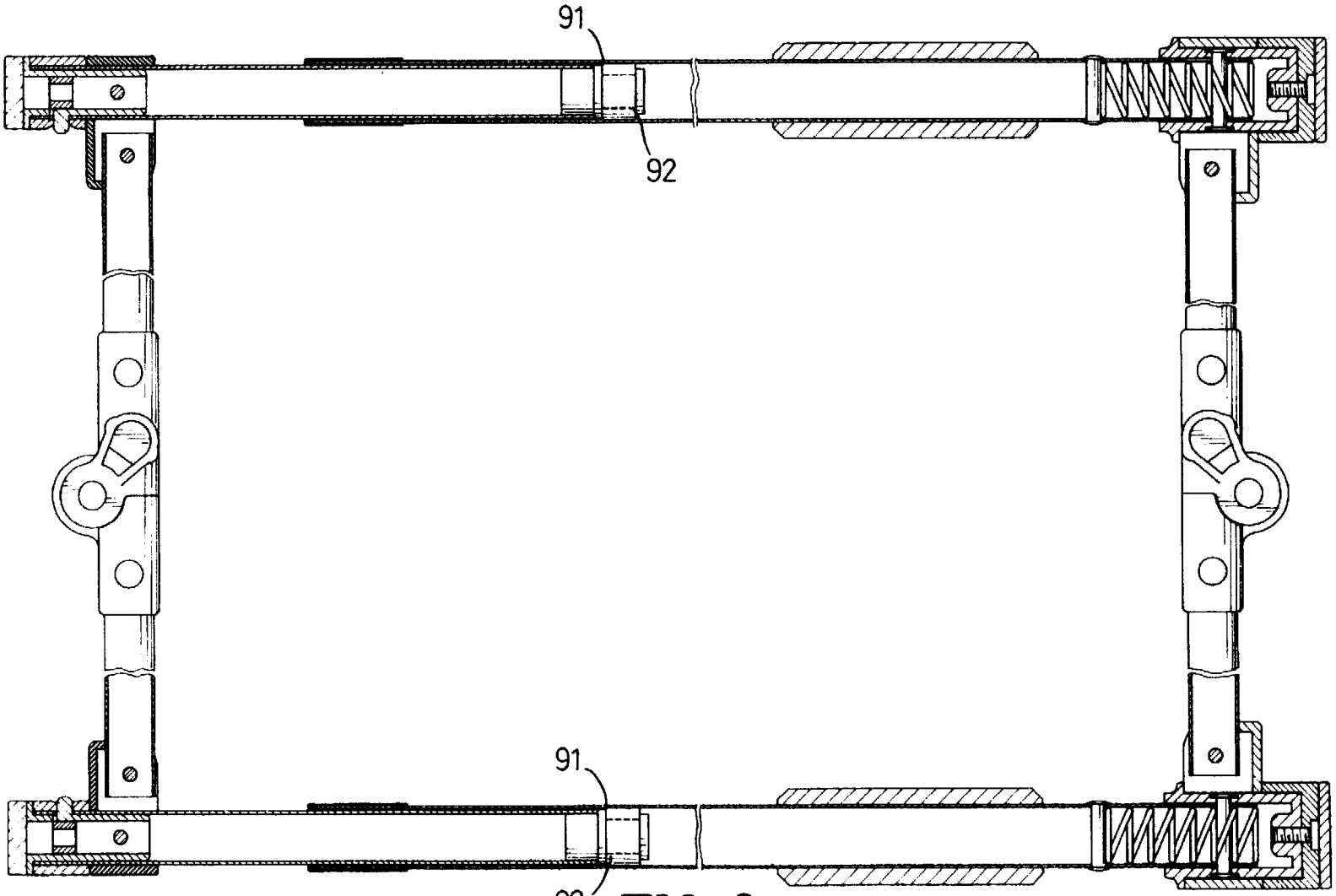
FIG. 3 is a partial cross sectional plan view of the foldable fence constructed in accordance with the invention.
Figure 6:
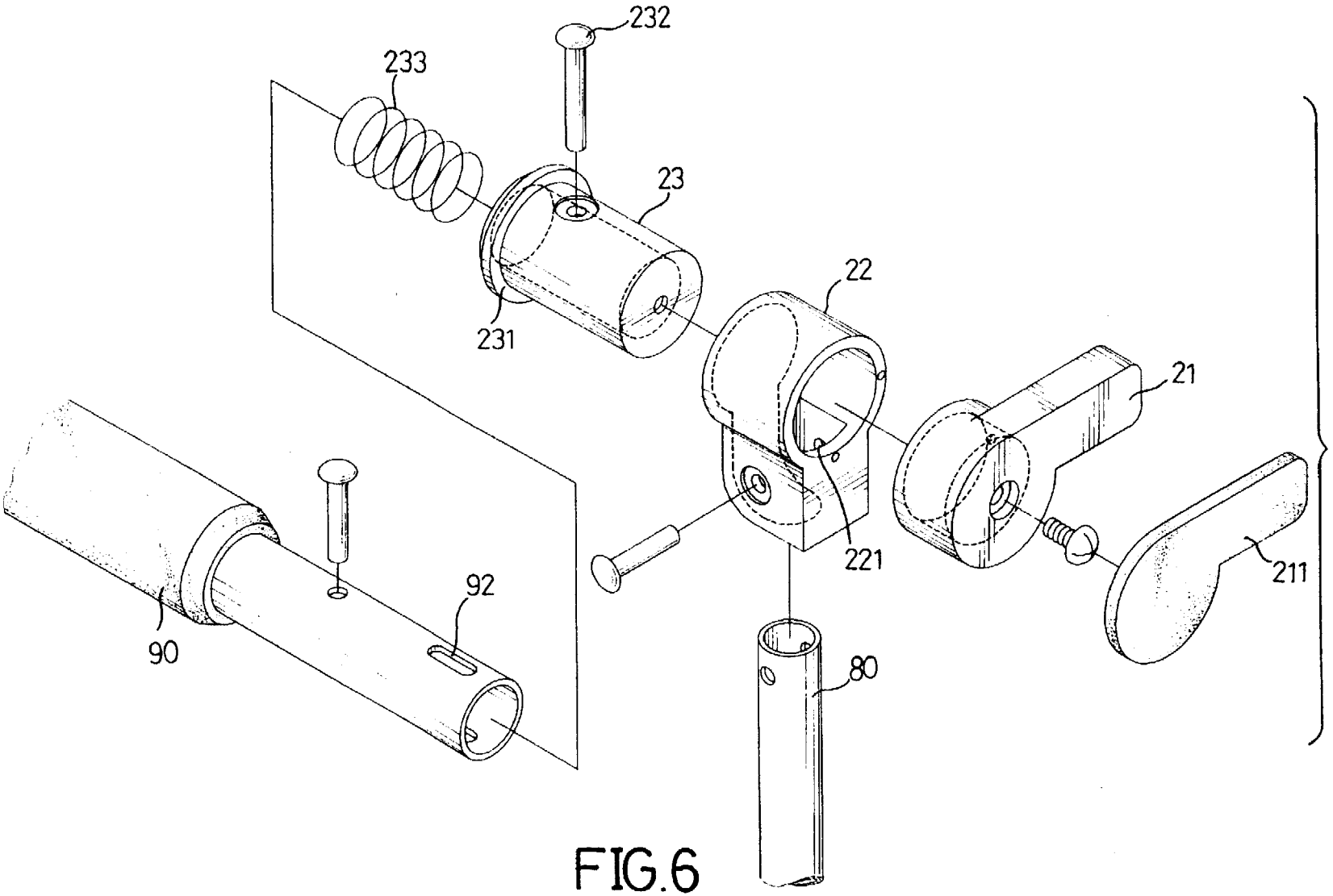
FIG. 6 is a partial exploded view of a second supporting means.

Now referring to FIG. 6, the second means 20 is shown. The second supporting means 20 comprises a seat 21 having a cover 211 configured and attached to one side of the seat 21. The seat 21 has a hole (not numbered) therein for securely fixing a connection tube 23 after a linking member 22 is fixedly connected therebetween with rivets (not numbered). The linking member 22 freely rotatably around the connection tube 23 and confined between a shoulder 231 of the connection tube 23 and the seat 21 has a recess 221 providing a space for a rivet 232 to move back and forth after the rivet 232 has fixed a resilient member 233 within the connection tube 23. While fixing the resilient member 233, the rivet 232 also extends another distal end of the tube 90 through a through hole 92 defined therein. Therefore, it is noted that when one distal end of the tube 90 is being extended between surfaces, such as, two walls (not shown), and the length of the tube 90 is fixed by the eccentric member 91 (see FIG. 3), the resilient member 233 will provide a resilient force abutting between the two walls because of the space of the recess 221 and the through hole 92 providing for the moving of the rivet 232.

Figure 7:
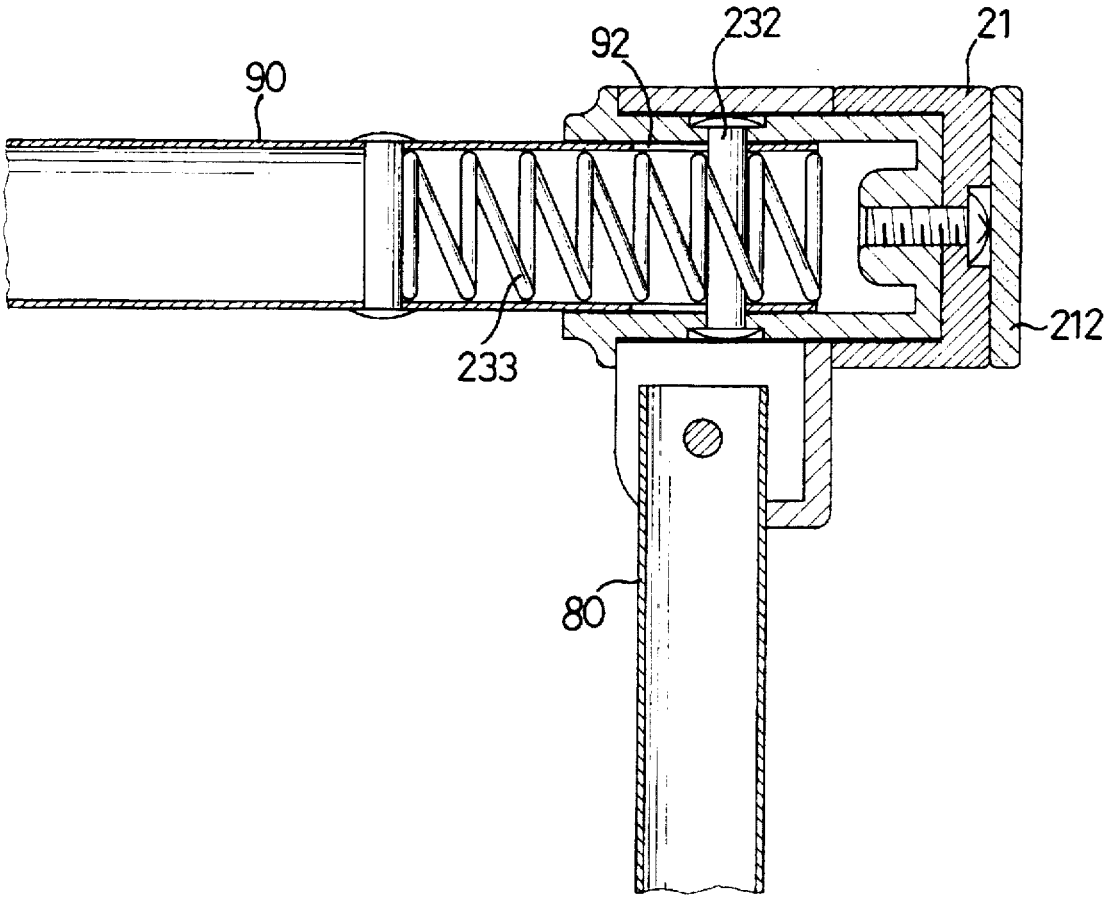
FIG. 7 is a schematic view showing the operation of FIG. 6.

Referring to FIG. 7 and taking FIG. 6 as reference, it is noted that when the cover 211 is urged against a surface, such as, a wall (not shown), the rivet 232 will move within the through hole 92, thus the resilient member 233 being compressed by the rivet 232 provides a resilient force to the cover 211 to firmly secure the tube 90 between the walls.

Figure 8:
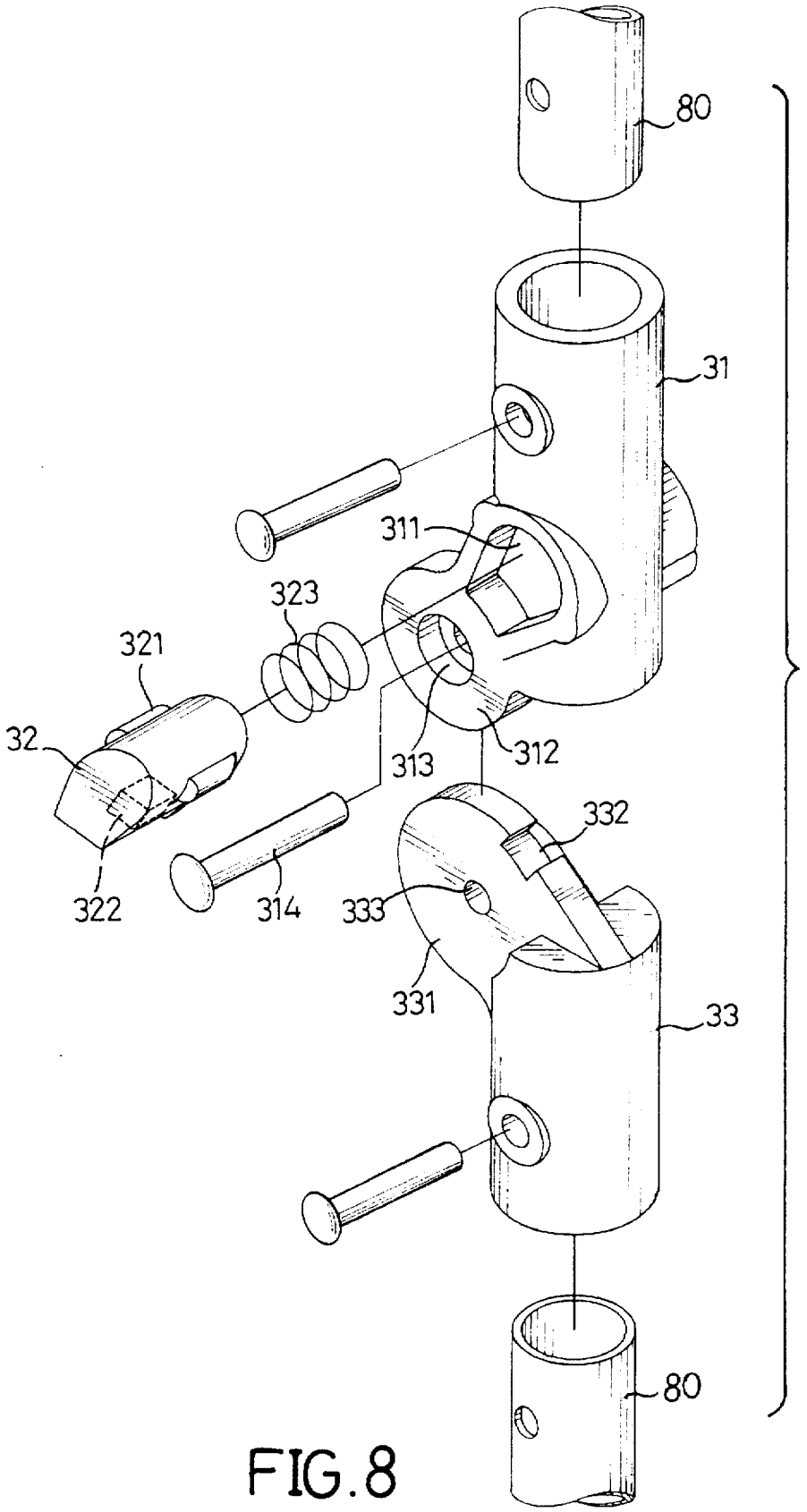
FIG. 8 is an exploded view of a folding means.
Figure 9:
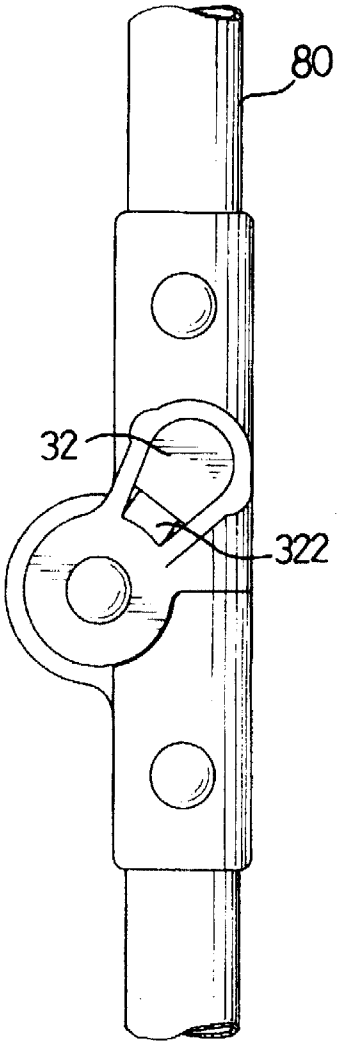
FIG. 9 is a plan view of the folding means when assembled together.
Figure 10:
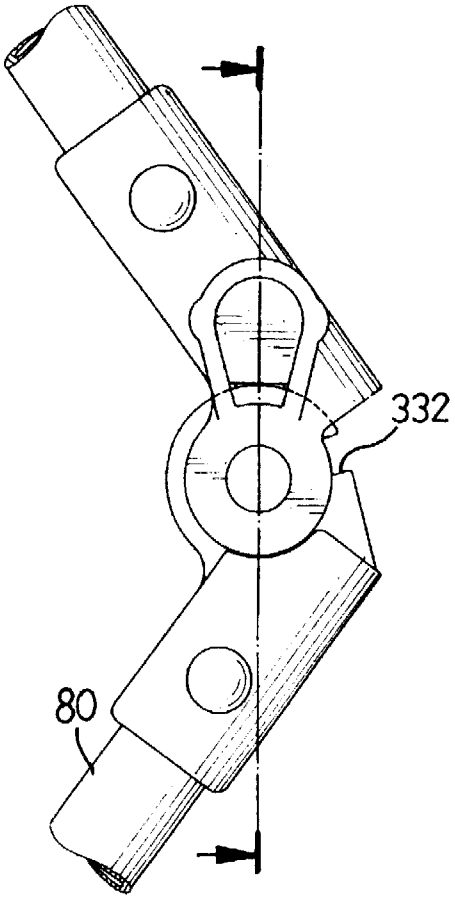
FIG. 10 is a schematic view showing the operation of the folding means of FIG. 8.
Figure 11:
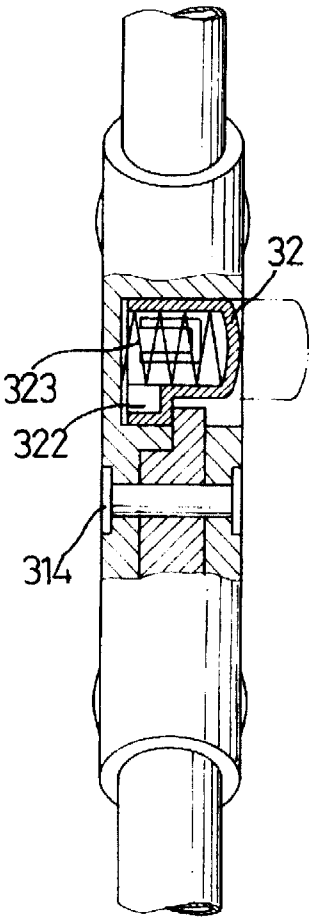
FIG. 11 is a cross sectional view of the folding means taken A—A line of FIG. 10.

Referring to FIG. 8, the folding means 30 is shown. The folding means 30 installed between two second supporting means 20 comprises a hollow L-shaped connector 31 having a side hole 311 permitting a button 32 to be slidably received therein and an inclined extending portion 312 with a hole 313 for receiving a rivet 314 therein, a controlling member 33 with a inclined projection 331 having a notch 332 thereon for receiving a boss 322 formed on a lower side of the button 32 and a hole 333 for receiving the rivet 314 to firmly secure the controlling member 33 with the L-shaped connector 31. Before the button 322 enters into the hole 313, a resilient unit 323 is first received within the button 32, so that the button 32 will be moved back when an external force is applied thereon. The button 32 has two opposite sides on each of which a wing 321 is formed, which is to prevent the button 32 from being ejected from the hole 313 when the external force is no longer applying onto the button 32. Now referring to FIGS. 9, 10 and 11, which are respectively plan views and cross sectional view of the folding means 30. When the folding means 30 is assembled together, the boss 322 of the button 32 rests in the notch 332 of the controlling means 33, therefore the folding means 30 is not able to be folded. When an external force is applied onto the button 32 and pushes the button 32 into the hole 313 of the connector 31, the boss 322 leaves the notch 332 of the controlling member 33 and permits the folding operation of the folding means 30.

Figure 12:
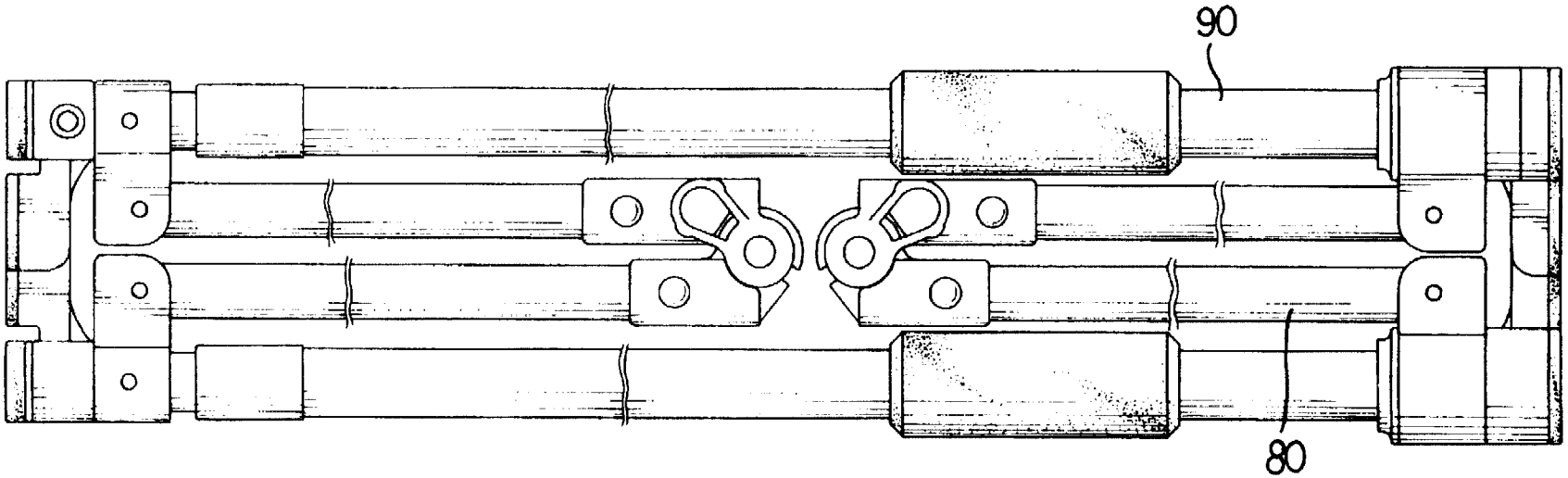
FIG. 12 is one preferred embodiment of the invention showing the folding positions of the tube and the supporting rod.

Referring to FIG. 12 of the preferred embodiment of the invention, the foldable fence constructed in accordance with the present invention can be folded together when both of the buttons 32 connected between two first supporting means 10 and second supporting means 20 are pressed and pushed into the hole 313 of the L-shaped connector 31 so that the supporting rods 80 are able to be folded together, and the tubes 90 just close towards each other while the supporting rods 80 are folding.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A foldable fence comprising:

a plurality of first supporting means;

a plurality of second supporting means;

a plurality of tubes each having two distal ends securely fixed to said first supporting means and said second supporting means and two mid-sections each rotatably received within the other;

an eccentric member enclosed within one of said tubes;

a plurality of supporting rods each pivotally connected between two of said first supporting means and two of said second supporting means; and a plurality of folding means connected between two of said first supporting means and two of said second supporting means, said folding means comprising:

a hollow L-shaped connector having a side hole;

a button slidably received within said side hole;

an inclined extending portion with a hole for receiving a rivet therein; and a controlling member with an inclined projection having a notch therein for receiving a boss formed on a lower side of said button and a hole for receiving said rivet to firmly secure the controlling member with said L-shaped connector.

2. The foldable fence as claimed in claim 1, wherein said first supporting means comprises an end having an annular projection extending axially and a boss integrally formed on the projection;

a driving plate rotatably enclosing said annular projection therein and having a hole for receiving said boss of said end; and a coupler securely fixed on said annular projection for fixedly connecting with one distal end of said tube and pivotally connected with one distal end of said supporting rod.

3. The foldable fence as claimed in claim 1, wherein said second supporting means comprises:

a seat having:

a cover configured and attached to one side of said seat, and a hole therein;

a connection tube fixedly secured within said seat through said hole;

a linking member rotatably mounted on said connection tube for pivotally connecting said supporting rod having a recess;

a rivet slidably received within said recess and securely fixed said connection tube and said tube; and a resilient means received within said connection tube and confined between said rivet and said seat.

4. The foldable fence as claimed in claim 2, wherein said driving plate is confined between said annular projection and said coupler.

5. The foldable fence as claimed in claim 1, wherein said button further comprises a pair of wings each integrally and perpendicularly formed on two sides of said button.

6. The foldable fence as claimed in claim 1, wherein said inclined projection of said controlling member is rotatably received within said extending portion by said rivet.

7. The foldable fence as claimed in claim 1, wherein said folding means further comprises a resilient unit confined between said button and an inner face of said L-shaped connector.

8. The foldable fence as claimed in claim 7, wherein said resilient unit is a spring.

* * * * *